United States Patent [19]

Nishimura et al.

[11] 4,128,460

[45] Dec. 5, 1978

[54] COLORING BY ELECTROLYSIS OF ALUMINUM OR ALUMINUM ALLOYS

[75] Inventors: Hideo Nishimura; Seishi Masaki; Takao Miyauchi; Nariyoshi Kobayashi, all of Kobe, Japan

[73] Assignee: Daiwa Kasei Kenkyujo Kabushiki Kaisha, Kobe, Japan

[21] Appl. No.: 830,547

[22] Filed: Sep. 6, 1977

[30] Foreign Application Priority Data

Sep. 13, 1976 [JP] Japan ..... 51-108844
Aug. 2, 1977 [JP] Japan ..... 52-92186

[51] Int. Cl.[2] ..... C25D 11/22
[52] U.S. Cl. ..... 204/35 N
[58] Field of Search ..... 204/35 N, 38 A, 42; 260/429 K

[56] References Cited

U.S. PATENT DOCUMENTS

| | | | |
|---|---|---|---|
| 3,341,561 | 9/1967 | Starks | 260/429 K |
| 3,849,263 | 11/1974 | Gedde | 204/35 N |
| 3,977,948 | 8/1976 | Martinez | 204/35 N |

*Primary Examiner*—John H. Mack
*Assistant Examiner*—William Leader
*Attorney, Agent, or Firm*—Seidel, Gonda & Goldhammer

[57] ABSTRACT

Coloring by electrolysis of aluminum or aluminum alloys comprising electrolyzing anodized aluminum or aluminum alloys without sealing the anodized surface thereof in an electrolytic bath containing an aliphatic sulfonic acid and a metal salt of such sulfonic acid.

11 Claims, No Drawings

COLORING BY ELECTROLYSIS OF ALUMINUM OR ALUMINUM ALLOYS

BACKGROUND OF THE INVENTION

1. Field of the Invention

The present invention relates to coloring by electrolysis of aluminum or aluminum alloys and, more particularly, to the use of a treating bath containing a certain aliphatic sulfonic acid and a metal salt of such sulfonic acid in the coloring by electrolysis.

2. Description of the Prior Art

Heretofore, known methods of coloring aluminum or aluminum alloys include a method of coloring a chemically formed coating on the aluminum and a method of coloring an anodized coating on the aluminum or aluminum alloy. Particularly, with respect to the latter there may be mentioned primary electrolytic coloring methods, secondary electrolytic coloring methods, and methods which comprise forming an anodized coating on aluminum and then coloring the coating. Among the primary methods are a spontaneous coloring method and a method of using an organic acid. As secondary methods, a method of electrolyzing with an alternating current in an acidic solution of a heavy metal salt is well known (Japanese Patent Application Publication No. 1715/1963).

However, these prior art methods have a number of disadvantages. For example, in the method of coloring the chemicaly formed coatings, the life of the treating liquid is short, the resistance to corrosion and the strength of the coating are poor, and the stability of the treating liquid is low due to the use of a strong oxidizing agent such as chromates, bichromates, permanganates and the like, thereby producing uneveness of coloring and changes in color tones. Further it is impossible to control the treating liquid and color tones of the coating. The hardness of the colored coating obtained is also sufficient. On the other hand, the above-mentioned method of coloring by electrolysis with an alternating current has eliminated these disadvantages but still has difficulty coloring uniformly and exhibits poor covering power. Later, this method was improved by adding a tin salt to an electrolyzing bath (Japanese Patent Application Publication No. 37823/1971). However, when the amount of an article to be treated is increased, the stability of the liquid and the reproducibility of color tones are reduced, and ultimately white precipitates form and the liquid turns yellow so that it is unable to function.

The reason why this bath is unstable is that stannous sulfate per se is liable to undergo hydrolysis to produce insoluble precipitates. This tendency is notable particularly in a dilute acidic tin bath. In order to prevent this tendency, organic acids such as cresol sulfonic acid, phenol sulfonic acid and the like have been added to the bath in a small amount. However, oxidation of tin still could not be sufficiently controlled. Further, the use of these phenol sulfonic acid type agents cause serious environmental problems which is a fatal defect.

We made studies to obviate the disadvantages and defects of the prior art methods mentioned above, and have now found that, by using a certain aliphatic sulfonic acid such as unsubstituted or hydroxy-substituted alkane sulfonic acids together with a metal salt of such sulfonic acids as a principal component in an electrolyzing bath used for the production of colored Alumite, the stability of the electrolyzing bath is remarkably improved and particularly superior uniform coloring can be obtained. It has also been found that the colored coating obtained has superior resistances to corrosion, light, sunlight and abrasion, high flexural strength and superior workability.

Further, as compared with phenol sulfonic acid type agents these aliphatic sulfonic acids or metal salts thereof have little problem in the prevention of environmental pollution and at the same time give a number of better results. When subjected to electrolysis for a long period of time, a tin salt of a hydroxy-containing sulfonic acid produces no white precipitates due to the oxidation mentioned above. The reason for this is believed to be that the hydroxy-containing alkane sulfonic acid prevents the metal salt from oxidizing because the sulfonic acid per se is a reducing acid.

Accordingly, it is an object of the present invention to provide a method of forming a colored coating having excellent resistances to corrosion, sunlight, heat and the like on aluminum or aluminum alloys by electrolyzing aluminum or alloys in a bath containing a certain aliphatic sulfonic acid and a metal salt of such sulfonic acid, which bath has high stability, provides a clear and uniform coloring and produces no environmental pollution.

SUMMARY OF THE INVENTION

This and other objects of the present invention are accomplished by a method of coloring by electrolysis which comprises anodizing aluminum or alloys and then, without treatment of sealing the anodized surface, electrolyzing the aluminum or alloys in a bath containing a certain aliphatic sulfonic acid such as alkane sulfonic acids and hydroxy-containing sulfonic acids.

A feature of the method of the present invention is to anodize aluminum or aluminum alloys by conventional processes and then to electrolyze the anodized aluminum without sealing treatment. Another feature of the present invention is to use an electrolyzing bath containing as a principal component an aliphatic sulfonic acid together with a metal salt of such sulfonic acid. It is essential to use in combination a sulfonic acid as an electrolyte and a metal salt of such sulfonic acid which is an agent for providing a color. Such electrolyzing bath produces no precipitates due to oxidation of a metal, and has high stability. The sulfonic acid accelerates penetration of a metal salt into a porous aluminum oxide coating, and, when electrolyzed, a metal or metal oxide is produced and deposited into the pores of the coating, thereby producing a clear and uniformly colored coating.

DETAILED DESCRIPTION OF THE INVENTION

Aliphatic sulfonic acids which are a principal component in the electrolyzing bath used in the method of coloring by electrolysis of the present invention are alkane sulfonic acids represented by the general formula:

$$R—SO_3H$$

wherein R represents a linear hydrocarbon radical having from 1 to 12, preferably from 2 to 6 carbon atoms. Illustrative of the alkane sulfonic acids are methane sulfonic acid, ethane sulfonic acid, propane sulfonic acid, 2-propane sulfonic acid, butane sulfonic acid, 2-butane sulfonic acid, pentane sulfonic acid, hexane sulfonic acid, decane sulfonic acid, dodecane sulfonic acid and the like. These alkane sulfonic acids may be used alone or in combination.

Another class of aliphatic sulfonic acids used in the electrolyzing bath in the method of the present invention are hydroxy-containing sulfonic acids represented by the general formula:

$$HO—R'—SO_3H$$

wherein R' represents a saturated or unsaturated, linear or branched hydrocarbon radical having from 2 to 12, preferably from 2 to 6 carbon atoms, and the hydroxyl and sulfonic acid groups are attached to any carbon atom of the hydrocarbon radical with the proviso that they are not on the same carbon atom. Illustrative of the hydroxy-containing alkane sulfonic acids are isethionic acid, 2-hydroxy propane-1-sulfonic acid, 1-hydroxy propane-2-sulfonic acid, 3-hydroxy propane-1-sulfonic acid, 2-hydroxybutane-1-sulfonic acid, 4-hydroxybutane-1-sulfonic acid, 2-hydroxypentane-1-sulfonic acid, 2-hydroxypentane-1-sulfonic acid, 2-hydroxydecane-1-sulfonic acid, 2-hydroxydodecane-1-sulfonic acid and the like. These hydroxy-containing alkane sulfonic acids may be used alone or in combination. Of course, they can be used in combination with the alkane sulfonic acid as described above.

The alkane sulfonic acids or hydroxy-containing alkane sulfonic acids used in the electrolyzing bath in the present invention include salts of a heavy metal such as tin, lead, nickel, zinc, copper, iron, silver, chromium, cobalt, manganese, cadmium, titanium, indium and the like. They may be used alone or in combination. As examples of the combination may be mentioned tin-zinc, tin-nickel, tin-lead, tin-copper, tin-indium, lead-copper, lead-nickel, lead-zinc, nickel-copper, nickel-zinc, zinc-copper or similar combinations.

In the electrolyzing bath used in the method of the present invention, the aliphatic sulfonic acids are used in an amount of 10–300 g per liter of electrolyzing liquid and the metal salts of the sulfonic acid are used in an amount of 2–50 g/l(calculated as metal). More specifically, the alkane sulfonic acids are used in general in an amount of 10–300 g/l, preferably 30–80 g/l, and the metal salts thereof are used in general in an amount of 2–50 g/l, preferably 5–20 g/l. The hydroxy-containing alkane sulfonic acids are used in general in an amount of 10–250 g/l, preferably 30–70 g/l, and the metal salts thereof are used in general in an amount of 2–40 g/l, preferably 3–15 g/l.

The electrolyzing liquid comprises aqueous medium, and water is a preferred medium for various reasons. If necessary, the liquid may contain other additives which do not adversely affect the effectiveness of the bath.

In practice, the method of the present invention is carried out as follows. Aluminum is first pretreated according to conventional means such as mechanical and(or) chemical polishing, dewaxing with neutral detergents or organic solvents, washing with water and then drying. The pretreated, cleaned aluminum is then anodized in an electrolyzing bath containing sulfuric acid or other acids according to conventional processes. The anodized aluminum is subjected to the coloring by electrolysis according to the method of the present invention without sealing the anodized surface.

Electrolysis is carried out under a current such as alternating current, A.C.-D.C. superimposed current and the like, at a voltage of 5–30 V, in the vicinity of ambient temperature for 1–30 minutes. These conditions may be varied according to the degree of coloring.

Although the mechanism of the coloring by electrolysis according to the present invention can not be fully understood, it is believed that a sulfonic acid inhibits precipitation due to oxidation of a metal salt thereby stabilizing the treating bath, and also enhances penetration of the metal salt into the porous, anodized coating on aluminum. When electrolyzed, the metal salt produces a metal or metal oxide to deposit it in pores of the coating to produce a clear and uniform color. Colors appear in accordance with the types of the metal salts and also may be varied depending on such conditions as treating time, temperature, voltage and the like.

The following examples are provided to illustrate the present invention but not to limit it.

EXAMPLES 1–9

An aluminum plate (52S), 1 mm × 50 mm × 100 mm was pretreated by conventional processes, then anodized in a bath containing sulfuric acid to provide a coating having a thickness of about 10μ, and then washed with distilled water. The anodized aluminum was electrolyzed in a bath of the present invention with an alternating current by making it into anode and carbon electrode into cathode. The compositions of the bath, the conditions of electrolysis and the color tones are shown in Table I below.

TABLE I

| Examples | Composition of Bath (metal salt was calculated as metal) | | Voltage (V) | Time (mins.) | Color Tones |
|---|---|---|---|---|---|
| 1 | tin methane sulfonate ($Sn^{++}$)<br>methane sulfonic acid | 10 g/l<br>40 | 12 | 5 | light bronze |
| 2 | tin propane sulfonate ($Sn^{++}$)<br>propane sulfonic acid | 10<br>60 | 12 | 5 | " |
| 3 | tin methane sulfonate ($Sn^{++}$)<br>copper methane sulfonate($Cu^{++}$)<br>methane sulfonic acid | 10<br>1<br>40 | 15 | 3 | deep bronze |
| 4 | the same as No. 1 | | 15 | 5 | black |
| 5 | the same as No. 3 | | 15 | 5 | " |
| 6 | tin ethane sulfonate ($Sn^{++}$)<br>lead ethane sulfonate (Pb)<br>ethane sulfonic acid | 15<br>5<br>50 | 12 | 3 | greenish brown |
| 7 | copper methane sulfonate ($Cu^{++}$)<br>methane sulfonic acid | 20<br>50 | 12 | 3 | reddish black |
| 8 | tin methane sulfonate ($Sn^{++}$)<br>silver methane sulfonate (Ag)<br>methane sulfonic acid | 10<br>0.2<br>40 | 15 | 5 | deep brown |
| 9 | tin ethane sulfonate ($Sn^{++}$)<br>ethane sulfonic acid<br>2-hydroxypropane sulfonic acid | 10<br>25<br>25 | 12 | 5 | light bronze |

EXAMPLES 10–18

A series of electrolytic coloring experiments were conducted according to the same procedures as those of the preceeding Examples. The results obtained are shown in Table II below.

TABLE II

| Examples | Composition of Bath (the metal salt was calculated as metal) | | Voltage (V) | Time (mins.) | Color Tones |
|---|---|---|---|---|---|
| | 2-hydroxyethane-1-sulfonic acid | 40 g/l | | | |
| 10 | tin 2-hydroxyethane-1-sulfonate($Sn^{++}$) | 4 g/l | 12 | 5 | bronze |
| | nickel 2-hydroxyethane-1-sulfonate ($Ni^{++}$) | 1 | | | |
| | 2-hydroxyethane-1-sulfonic acid | 50 | | | |
| 11 | copper 2-hydroxyethane-1-sulfonate ($Cu^{++}$) | 3 | 15 | 2 | light red |
| | lead 2-hydroxyethane-1-sulfonate (Pb) | 2 | | | |
| | 2-hydroxypropane-1-sulfonic acid | 50 | | | |
| 12 | tin 2-hydroxypropane-1-sulfonate ($Sn^{++}$) | 5 | 10 | 2 | light bronze |
| 13 | the same as No. 3 | | 12 | 4 | deep bronze |
| 14 | the same as No. 3 | | 15 | 5 | black |
| | 2-hydroxypropane-1-sulfonic acid | 30 | | | |
| 15 | tin 2-hydroxypropane-1-sulfonate($Sn^{++}$) | 4 | 12 | 3 | greenish |
| | lead 2-hydroxypropane-1-sulfonate(Pb) | 1 | | | brown |
| 16 | 2-hydroxypropane-1-sulfonic acid | 50 | | | |
| | Copper 2-hydroxypropane-1-sulfonate ($CU^{++}$) | 5 | 10 | 1.5 | reddish black |
| 17 | the same as No. 7 | | 15 | 5 | black |
| | 2-hydroxybutane-1-sulfonic acid | 50 | | | |
| 18 | tin 2-hydroxybutane-1-sulfonate($Sn^{++}$) | 1 | 12 | 3 | deep bronze |
| | copper 2-hydroxybutane-1-sulfonate ($Cu^{++}$) | 1 | | | |

What is claimed is:

1. A method of coloring aluminum or aluminum alloys by electrolysis which comprises anodizing aluminum or aluminum alloys and electrolyzing the anodized aluminum or alloys without sealing the anodized surface thereof in a bath containing an aliphatic sulfonic acid and a metal salt of said sulfonic acid.

2. A method according to claim 1 wherein said aliphatic sulfonic acid is selected from the group consisting of an alkane sulfonic acid represented by the general formula:

$$R—SO_3H$$

wherein R represents a linear hydrocarbon radical having from 1 to 12 carbon atoms, and a hydroxy-containing sulfonic acid represented by the general formula:

$$HO—R'—SO_3H$$

wherein R' represents a saturated or unsaturated, linear or branched hydrocarbon radical having from 2 to 12 carbon atoms, and the hydroxyl and sulfonic acid groups are attached to any carbon atom of the hydrocarbon radical with the proviso that they are not on the same carbon atom; and said metal salt is a salt of a heavy metal.

3. A method according to claim 2 wherein said aliphatic sulfonic acid is used in an amount of from 10 to 300 g/l and said metal salt is used in an amount of from 2 to 50 g/l (calculated as metal).

4. A method according to claim 2 wherein said alkane sulfonic acid is selected from the group consisting of methane sulfonic acid, ethane sulfonic acid and propane sulfonic acid and combinations thereof, and said metal is selected from the group consisting of tin, copper, lead, silver and combinations thereof.

5. A method according to claim 4 wherein alkane sulfonic acid is used in an amount of from 10 to 300 g/l and said metal salt is used in an amount of from 2 to 50 g/l (calculated as metal).

6. A method according to claim 2 wherein said hydroxy-containing sulfonic acid is selected from the group consisting of 2-hydroxyethane-1-sulfonic acid, 2-hydroxypropane-1-sulfonic acid and 2-hydroxybutane-1-sulfonic acid and combinations thereof, and said metal is selected from the group consisting of tin, copper, lead, nickel and combinations thereof.

7. A method according to claim 6 wherein said hydroxy-containing sulfonic acid is used in an amount of from 10 to 250 g/l and said metal salt is used in an amount of from 2 to 40 g/l (calculated as metal).

8. A method according to claim 2 wherein R represents a linear hydrocarbon radical having from 2 to 6 carbon atoms.

9. A method according to claim 2 wherein R' represents a saturated or unsaturated, linear or branched hydrocarbon radical having from 2 to 6 carbon atoms.

10. A method according to claim 2 wherein R represents a linear hydrocarbon radical having from 2 to 6 carbon atoms and R' represents a saturated or unsaturated, linear or branched hydrocarbon radical having from 2 to 6 carbon atoms.

11. A method according to claim 1 wherein the metal salt is a salt of a heavy metal.

* * * * *